US010711422B2

(12) United States Patent
Canteri

(10) Patent No.: US 10,711,422 B2
(45) Date of Patent: Jul. 14, 2020

(54) PILE DRIVING VEHICLE

(71) Applicant: NORDWIND S.R.L., Bosco Chiesanuova (VR) (IT)

(72) Inventor: Renato Canteri, Bosco Chiesanuova (IT)

(73) Assignee: NORDWIND S.R.L., Bosco Chiesanuova (IT)

( * ) Notice: Subject to any disclaimer, the term of this patent is extended or adjusted under 35 U.S.C. 154(b) by 0 days.

(21) Appl. No.: 16/311,645

(22) PCT Filed: Jul. 11, 2017

(86) PCT No.: PCT/IB2017/054166
§ 371 (c)(1),
(2) Date: Dec. 19, 2018

(87) PCT Pub. No.: WO2018/011706
PCT Pub. Date: Jan. 18, 2018

(65) Prior Publication Data

US 2019/0234037 A1 Aug. 1, 2019

(30) Foreign Application Priority Data

Jul. 12, 2016 (IT) ..... 102016000072862

(51) Int. Cl.
*E02D 7/06* (2006.01)
*E04H 17/26* (2006.01)

(52) U.S. Cl.
CPC ..... *E02D 7/06* (2013.01); *E04H 17/263* (2013.01)

(58) Field of Classification Search
CPC ..... E02D 7/06; E02D 7/20; E04H 17/263
See application file for complete search history.

(56) References Cited

U.S. PATENT DOCUMENTS 574,660 A * 1/1897 Carroll ..... 173/50
3,395,766 A * 8/1968 Granville ..... E21B 7/021 173/189

(Continued)

FOREIGN PATENT DOCUMENTS

GB 2485918 A 5/2012

*Primary Examiner* — Carib A Oquendo
(74) *Attorney, Agent, or Firm* — Pearne & Gordon LLP

(57) ABSTRACT

This disclosure relates to a pile-driving vehicle (1), comprising a chassis (11), a movement system (15) for moving the vehicle (1) on a soil, a first driving apparatus (21) and a second driving apparatus (22). Each driving apparatus (21, 22), which is intended to drive a respective pile into the soil, comprises a first member (31) that is constrained to the chassis (11), a second member (32) that is movable relative to the first member (31) along a driving line (200) and an actuating device (33) for moving the second member (32) relative to the first member (31). The movement of the second member (32) comprising an outward stroke, during which the actuating device (33) pushes the second member (32) towards the soil, applying a force on the second member (32) along the driving line (200), and a return stroke, during which the second member (32) is moved away from the soil. The second member (32) is designed to transmit the force to the pile to be driven in. The first driving apparatus (21) and the second driving apparatus (22) can be operated alternately, in such a way that the outward stroke of the second member (32) of the first driving apparatus (21) corresponds to the return stroke of the second member (32) of the second driving apparatus (22), and vice versa. This disclosure also relates to a method for driving a plurality of piles into a soil.

19 Claims, 5 Drawing Sheets

(56) References Cited

U.S. PATENT DOCUMENTS

| | | | | |
|---|---|---|---|---|
| 3,752,242 | A * | 8/1973 | Gremillion | E21B 7/026 175/108 |
| 4,911,581 | A * | 3/1990 | Mauch | E02D 5/56 173/11 |
| 5,040,927 | A * | 8/1991 | Wickberg | E02D 7/20 173/189 |
| 5,490,568 | A * | 2/1996 | Rios | A01G 17/16 173/184 |
| 2007/0144360 | A1 * | 6/2007 | Heichel | E02D 7/18 100/137 |
| 2016/0138299 | A1 | 5/2016 | Powers, III | |

* cited by examiner

PILE DRIVING VEHICLE

This invention relates in general to the sector of strengthening of the foundations of the products of construction, such as buildings or other structures, and may be used both for existing and new foundations. In particular, this invention relates to a pile-driving vehicle.

In the sector, use is already known of piles that are driven into the soil and to which the foundations of the building are anchored. Moreover, machinery for driving in such piles has already been proposed.

In a first type of machinery, each pile is driven in by percussion. During the process, a heavy body is repeatedly raised and then released so that it falls onto a projecting end of the pile, which is consequently gradually driven into the soil. Therefore, it is a pulse technique, that uses the quantity of motion acquired by the heavy body during the fall in order to obtain a high level of force on the pile, like hammering.

In a second type of machinery, to which the subject matter of this invention belongs, each pile is driven in by applying a pressing force on it using a suitable device, for example, like a jack, which pushes the pile into the soil using the rest of the machinery as a counter-thrust support. Therefore, it is necessary that the reaction to the pressing force applied on the pile is suitably counter-balanced, otherwise the machinery would be lifted off the soil and would be unable to provide any more thrust. The possibility of counterbalancing the reaction therefore limits the force that can be applied on the pile and, as a result, the effectiveness of the strengthening.

A commonly used solution is to anchor the machinery to the soil, in such a way that the reaction force is transferred to the soil. In terms of the operations to be carried out at the site, that is an inconvenient and laborious operation. For example, if multiple piles have to be driven in, the machinery must be anchored in one position for a first pile (or a first group of piles, if the machinery is equipped with multiple driving devices operating simultaneously), then the machinery must be released from its anchoring, moved to a new position and anchored again for driving in a second pile (or a second group of piles), and so on for all of the piles.

Moreover, it should be considered that the mechanical characteristics of the soil could be unsatisfactory and, therefore, it may be difficult to suitably anchor the machinery to the soil, in particular when making a new foundation. In contrast, if operating on an existing foundation, in order to achieve suitable anchoring, it may be necessary to pierce the self-same foundation, making the operation even more laborious and difficult.

As an alternative to anchoring the machinery, several solutions have been proposed in which the weight of the machinery is such that it counterbalances the reaction. In these solutions, the maximum driving force corresponds at most to the weight of the machinery. Therefore, such machinery usually has a limited driving capacity and in particular is equipped with a single driving device. Consequently, the machinery must be moved after each individual pile-driving operation. Therefore, if a large number of piles have to be driven in, the operations involved may take a long time. In this context the technical purpose which forms the basis of this invention is to provide pile-driving machinery that allows at least some of the disadvantages of the prior art to be overcome, or that at least offers an alternative solution to the prior art machinery. The technical purpose specified and the aims indicated are substantially achieved by a pile-driving vehicle according to claim 1.

This invention also relates to a method for driving in a plurality of piles according to claim 14. Particular embodiments of this invention are defined in the corresponding dependent claims. According to one aspect of the solution proposed by this invention, the pile-driving machinery is a vehicle provided with a first driving apparatus and a second driving apparatus, each adapted to apply a force along a driving line on a respective pile to be driven in. The first driving apparatus and the second driving apparatus can be operated alternately, in such a way that the driving force on a first pile is not applied simultaneously with the driving force on a second pile. This is useful for limiting the weight of the vehicle to that required for counterbalancing the reaction of only one driving apparatus, meaning that it is possible to supply a vehicle that on one hand does not need to be anchored to the ground, and on the other hand can be moved more easily than heavier machinery.

At the same time, the presence of two driving apparatuses allows on-site operations to be speeded up, thanks to the time saved by the possibility of driving in two piles without having to move the vehicle.

In particular, while one driving apparatus pushes on a first pile with an outward stroke, the other driving apparatus performs a return stroke towards a position in which it is ready to push a second pile for a subsequent stretch, and so on. That is useful for speeding up driving operations, since the downtime due to the return stroke of one driving apparatus is a working time for the outward stroke of the other driving apparatus. Therefore, if each pile is constituted of a plurality of pieces that are driven in one after another, it is possible to drive in two piles in the time that, using prior art machinery with a single driving apparatus, would be needed for just one pile.

Further features and the advantages of this invention are more apparent in the detailed description below, with reference to an example, non-limiting embodiment of a pile-driving vehicle. Reference will be made to the accompanying drawings, in which.

Figure 11:
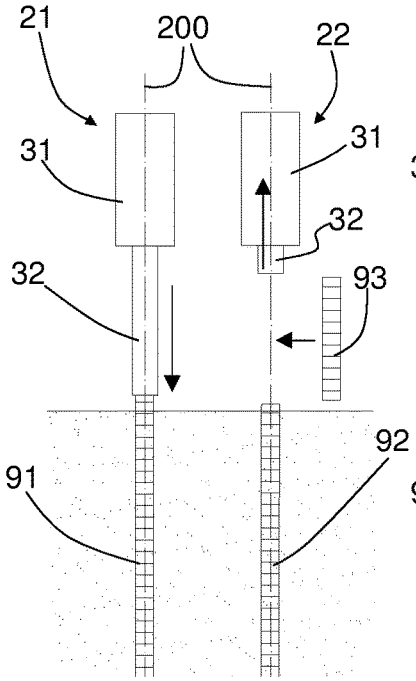
Figure 12:
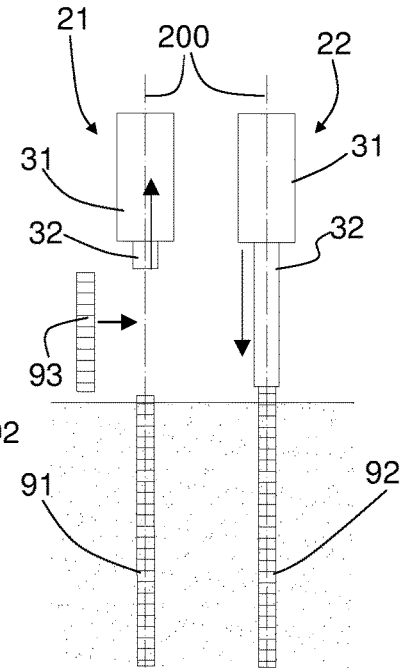
Figure 13:
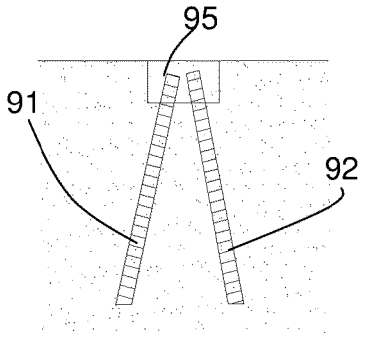

FIGS. 11 and 12 schematically illustrate two steps of pile driving with a vehicle according to this invention;

FIG. 13 illustrates a possible alternative embodiment of pile driving with a vehicle according to this invention.

With reference to the accompanying figures, the numeral 1 denotes a pile-driving vehicle according to this invention. The vehicle 1 is usable for driving piles into a soil or the like, for strengthening foundations or the self-same soil.

The vehicle 1 comprises a chassis 11, that acts as a supporting structure for the other components of the vehicle 1, and a movement system for moving the vehicle 1 on the soil or the like.

In the embodiments illustrated, the movement system comprises crawler tracks 15. Therefore, the vehicle 1 is a tracked vehicle. A movement system with crawler tracks 15 is useful for moving the vehicle 1 on uneven soils, as well as for distributing the weight of the vehicle 1 on a larger supporting surface area. However, alternatively, the movement system of the vehicle 1 could comprise wheels instead of crawler tracks.

The movement system may also comprise a motor, which may be electric or in the form of a combustion engine 30, mounted on the vehicle 1. In the embodiment illustrated, the movement system comprises for example two electric motors 16, one for each crawler track 15, which are mounted on the chassis 11 and are connected to the respective crawler tracks 15 by a suitable transmission system. In particular, each motor 16 drives a respective hydraulic pump that drives the operation of a respective crawler track 15. In an alternative embodiment, there may be only one motor 16 present, which drives two hydraulic pumps, or only one motor 16 that drives only one hydraulic pump which, by means of a suitable distributor, controls the two crawler tracks 15. In any case, thanks to the movement system the vehicle 1 is easily manoeuvrable and movable, so that it can be positioned where a pile has to be driven in. The movement system may also comprise a guiding device which allows an operator to manoeuvre the vehicle 1. In themselves, the detailed aspects of the movement system can be produced according to the prior art and no further description of them is provided. The vehicle 1 comprises a first driving apparatus 21, for driving a first pile into the soil or the like, and a second driving apparatus 22, for driving a second pile into the soil or the like.

Each driving apparatus 21, 22 is adapted to drive in the respective pile by applying a pressing force on it in along the driving line. The vehicle 1 therefore belongs to the above-mentioned second type of machinery.

Specifically, each driving apparatus 21, 22 comprises a first member 31 that is constrained to the chassis 11, a second member 32 that is movable relative to the first member 31 between a first position and a second position along a driving line 200. In the first position the second member 32 is at a distance from the soil compared with the second position, in which the second member 32 is near to the soil compared with the first position. In use, the second member 32 is translatable relative to the first member 31, with a reciprocating motion between the two positions. For example, the first member 31 comprises a base plate 310 that is mounted on the chassis 11 and rods 315 that guide the movement of the second member 32.

The driving apparatus 21, 22 also comprises an actuating device 33 for moving the second member 32 relative to the first member 31, applying a force on the second member 32 along the driving line 200. For example, each driving apparatus 21, 22 is or comprises a hydraulic piston or a jack.

Operation of the actuating devices 33 may be driven by the self-same hydraulic pumps that are driven by the motors 16. The pumps are used for moving the vehicle 1 or, when the vehicle 1 is stationary, for the driving apparatuses 21, 22.

The second member 32 is designed to transmit to the pile to be driven in, the force along the driving line that is applied by the actuating device 33. For example, the second member 32 is intended to make contact with an upper end of the pile, so that it presses directly on the end of the pile, to push the pile into the soil. In particular, the second member 32 comprises a plate-shaped thrust element 321, which is intended to make contact with the end of the pile.

Alternatively, the second member 32 may be designed to grasp the lateral surface of the pile with a grip such that it successfully transmits the force to the pile the along the driving line.

Considering the basics of operation of the driving apparatus 21, 22, the actuating device 33 applies a force on the second member 32 relative to the first member 31. The movement of the second member 32 relative to the first member 31 comprises an outward stroke towards the second position, during which the actuating device 33 pushes the second member 32 towards the soil: the force acting on the second member 32, which is a downward force, is transferred to the pile, which is therefore pushed into the soil. The reaction force acting on the first member 31, which is an upward force, is transmitted to the chassis 11 and is balanced by the weight of the vehicle 1. To guarantee that balancing, the vehicle 1 comprises at least one ballast 41 whose function is to increase the overall weight of the vehicle. That ballast 41 may take the form of one or more heavy bodies positioned on the chassis 11, or it may be incorporated in the self-same chassis 11. Alternatively, that ballast may not be necessary if the overall weight of the vehicle 1 were on its own sufficient to counterbalance the reaction force.

In the embodiment illustrated, the vehicle 1 comprises a first ballast 41 mounted in a front region of the chassis 11 and a second ballast 42 mounted in a rear region of the chassis 11.

Specifically, for the aim described herein, the overall weight of the vehicle 1 (with ballast, if necessary) is greater than the force that can be applied by the actuating device 33 of the first driving apparatus 21, and greater than the force that can be applied by the actuating device 33 of the second driving apparatus 22.

For example, the overall weight of the vehicle 1 is approximately 42 tons-force, whilst the driving force applicable by each driving apparatus 21, 22 is approximately 40 tons-force.

The movement of the second member 32 relative to the first member 31 also comprises a return stroke towards the first position, during which the second member 32 is moved away from the soil and the pile driven in.

According to this invention, the first driving apparatus 21 and the second driving apparatus 22 can be operated alternately, in such a way that the outward stroke of the second member 32 of the first driving apparatus 21 corresponds to the return stroke of the second member 32 of the second driving apparatus 22, and vice versa. In other words, their actuating devices 33 can be operated in opposite ways to each other: while one actuating device 33 pushes the respective second member 32 towards the second position, driving the respective pile for a stretch corresponding to the outward stroke, the other actuating device 33 returns the respective second member 32 towards the first position. Therefore, only one driving apparatus 21, 22 at a time pushes on a respective pile, whilst the other driving apparatus 21, 22 is prepared for the respective pushing step.

In particular, each pile may be composed of a plurality of pieces that are driven in one after another until the desired overall length and depth are reached. Piles of this type are already known.

Using the vehicle 1, two piles of that type can be driven in a substantially simultaneous way, alternating driving of the pieces of the first pile with driving of the pieces of the second pile. While one piece of the first pile is driven with the first driving apparatus 21, the second apparatus 22 is brought into the condition for receiving a piece of the second pile; then the piece of the second pile is driven with the second driving apparatus 22, while the first driving apparatus 21 is brought into the condition for receiving a subsequent piece of the first pile, and so on. In fact, the second member 32 in the first position is at a distance from the piece already driven in and therefore between them there is the space for positioning a subsequent piece to be driven in, thereby preparing the apparatus for the next driving step. That is schematically illustrated in FIGS. 11 and 12, where the first pile is labelled 91, the second pile is labelled 92 and a piece of pile is labelled 93.

Alternating operation of the driving apparatuses 21, 22 therefore allows optimisation of working timing: the time required for driving in the piece of one pile can be used to prepare driving of a piece of the other pile, thereby minimising downtimes.

Since the reaction of just one driving apparatus 21, 22 has to be counterbalanced, the overall weight of the vehicle (with ballast, if necessary) can be less than the sum of the force that can be applied by the actuating device 33 of the first driving apparatus 21 and the force that can be applied by the actuating device 33 of the second driving apparatus 22. In fact, since the two apparatuses 21, 22 are not intended to simultaneously push on the respective piles 91, 92, there is no need for the overall weight to be such that it counterbalances the sum of their reactions. That is useful for limiting the weight of the vehicle 1 to the weight effectively necessary. The alternating operation of the driving apparatuses 21, 22 is managed, for example, by an electronic control system.

Figure 1:
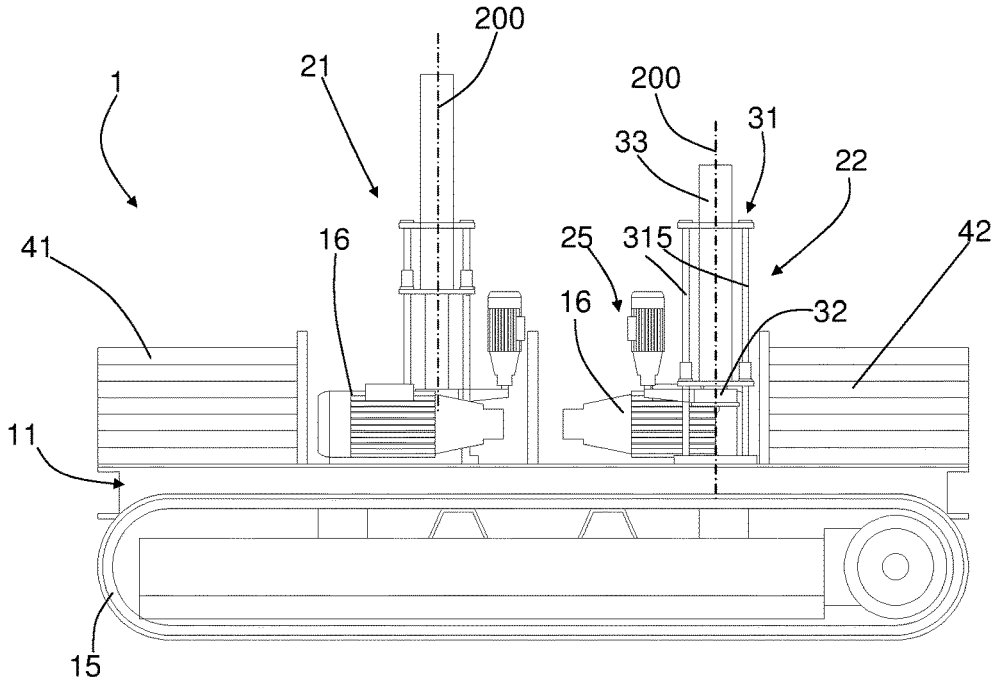
FIG. 1 is a side view of an embodiment of a pile-driving vehicle according to this invention.
Figure 2:
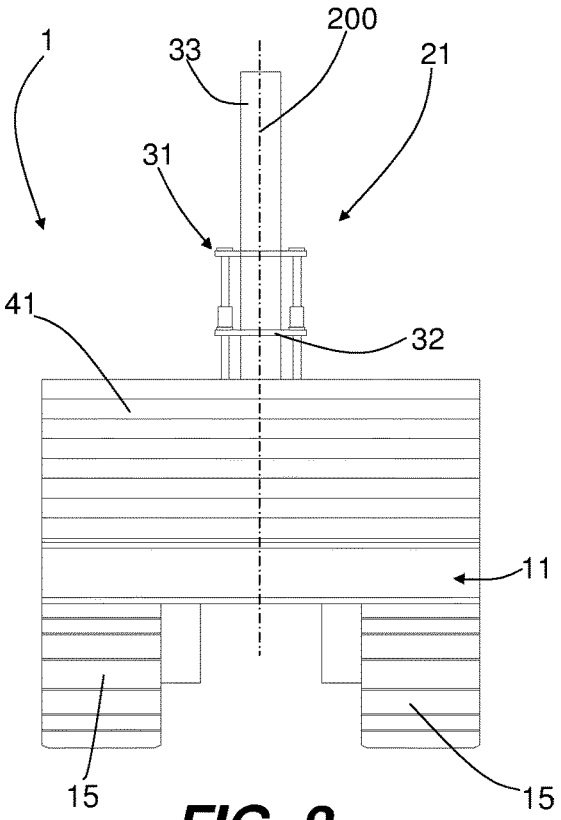
FIG. 2 is a front view of the vehicle of FIG. 1.
Figure 3:
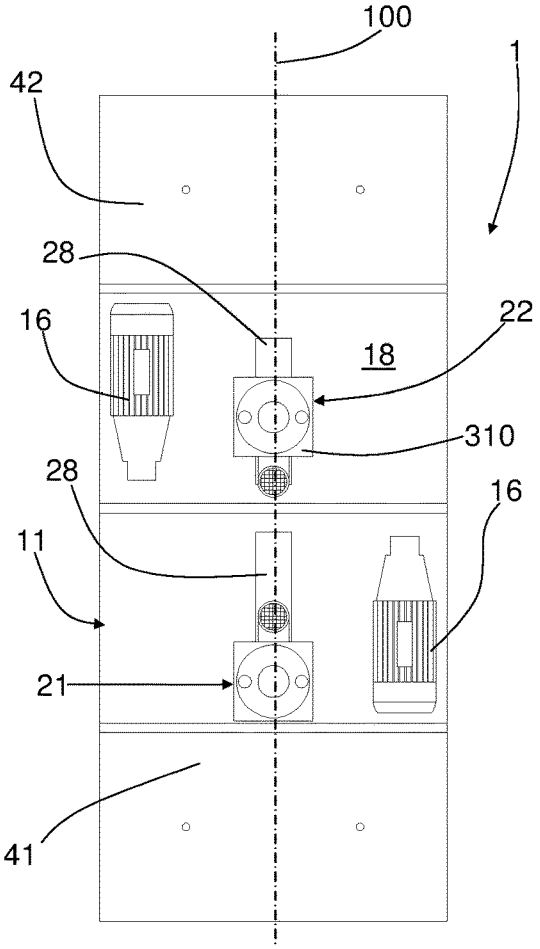
FIG. 3 is a top view of the vehicle of FIG. 1.
Figure 4:
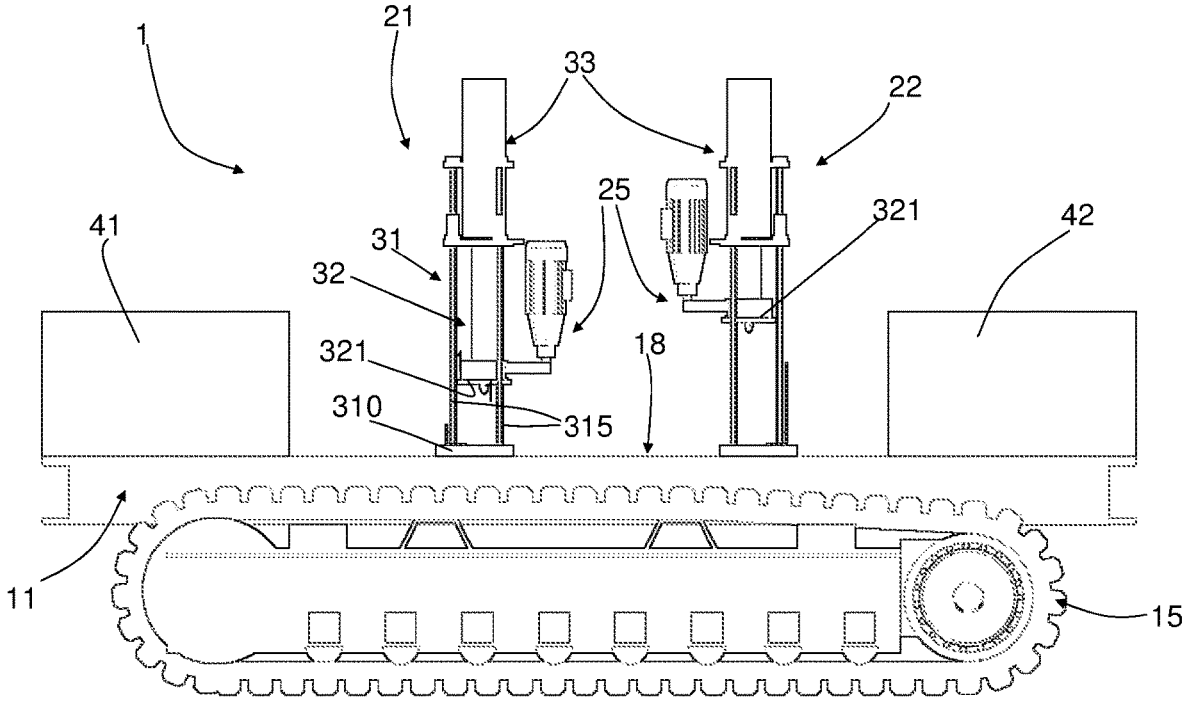
FIG. 4 is a side view of the vehicle of FIG. 1, from which several parts have been removed.
Figure 5:
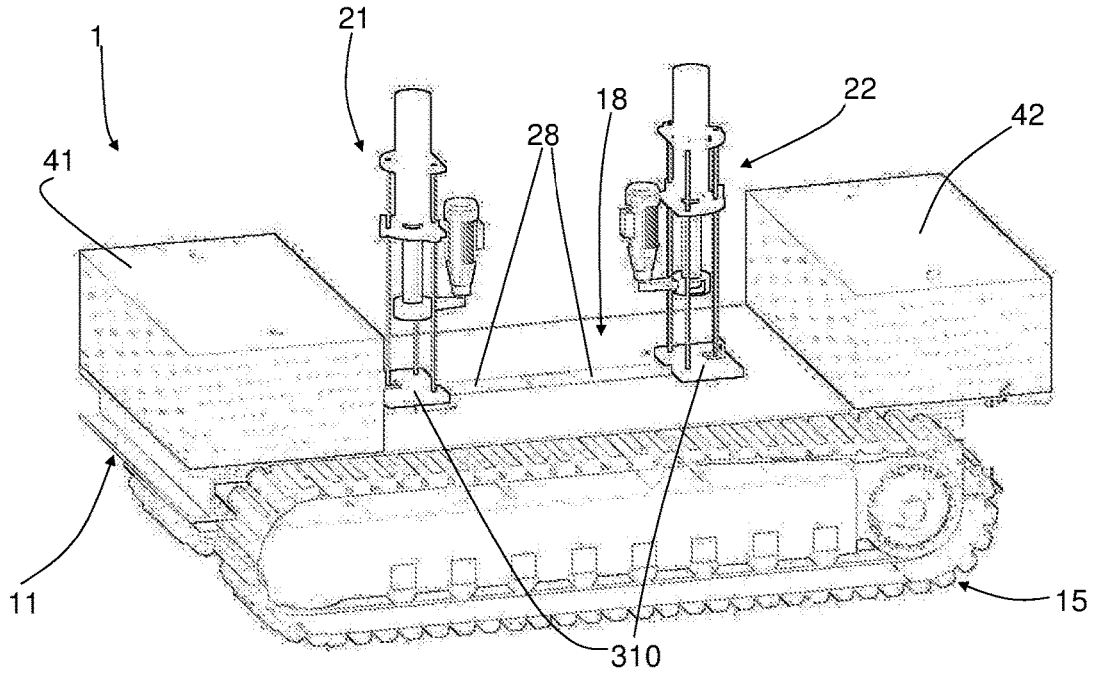
FIG. 5 is a perspective view of the vehicle of FIG. 1, from which several parts have been removed.
Figure 6:
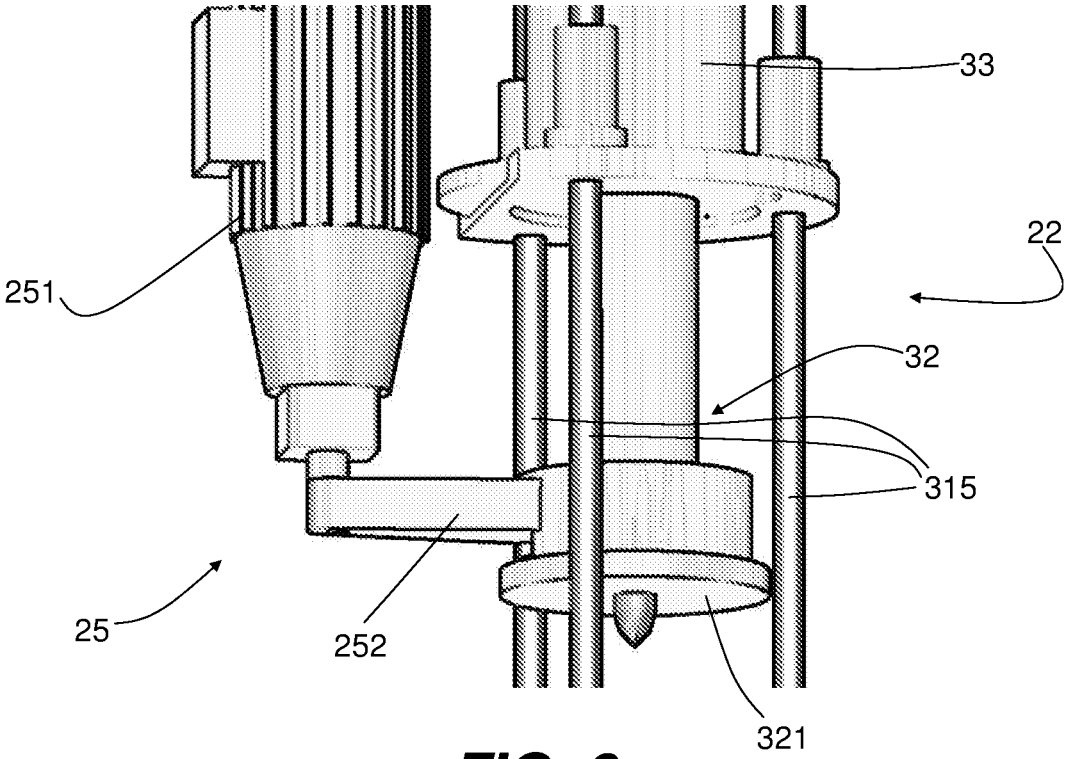
FIG. 6 is a perspective view of an enlarged detail of the vehicle of FIG. 1.
Figure 7A:
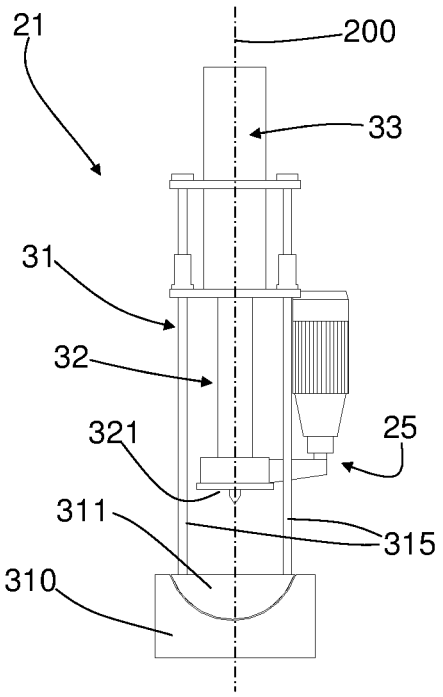
FIGS. 7A and 7B are respectively a side view and a front view of a driving apparatus that is part of the vehicle of FIG. 1, in a first operating position.
Figure 7B:
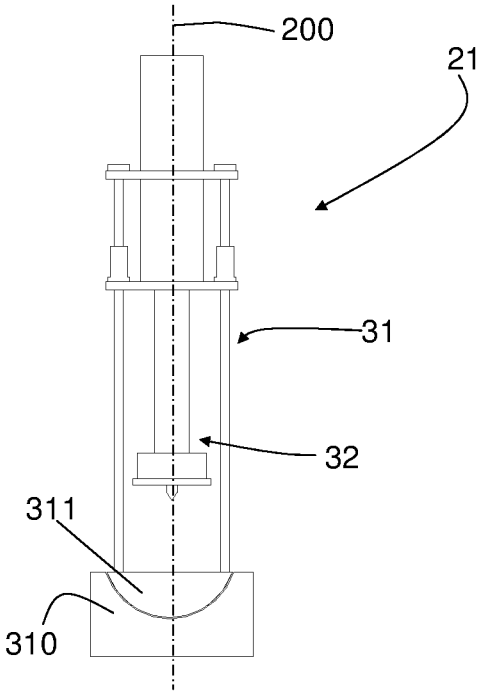
Figure 8A:
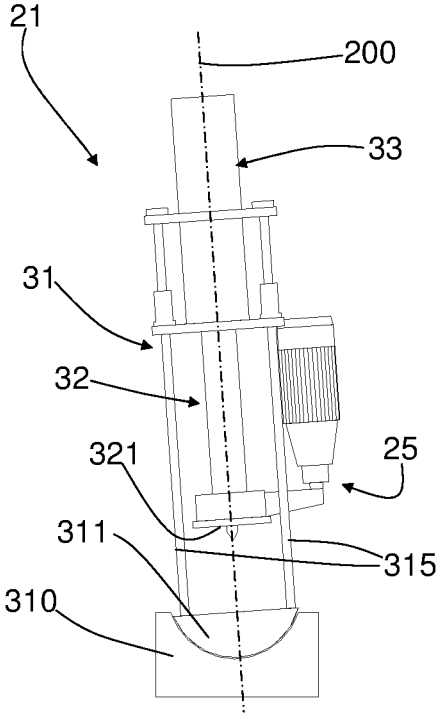
FIGS. 8A and 8B are respectively a side view and a front view of a driving apparatus that is part of the vehicle of FIG. 1, in a second operating position.
Figure 8B:
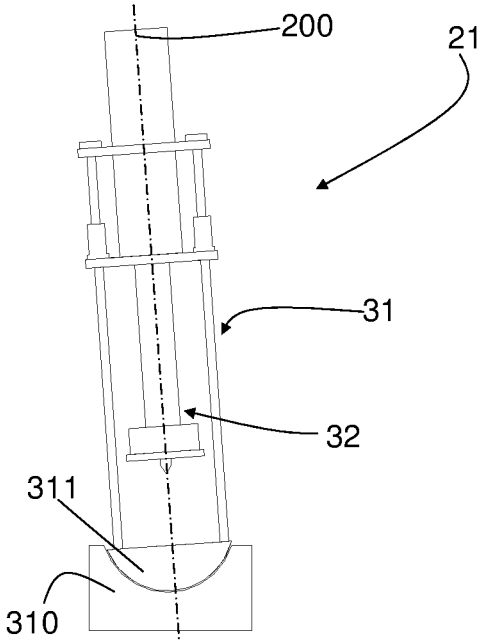
Figure 9A:
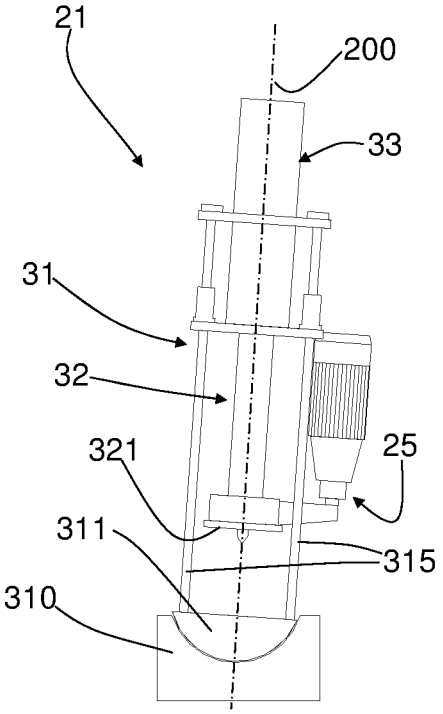
FIGS. 9A and 9B are respectively a side view and a front view of a driving apparatus that is part of the vehicle of FIG. 1 or of FIG. 4, in a third operating position.
Figure 9B:
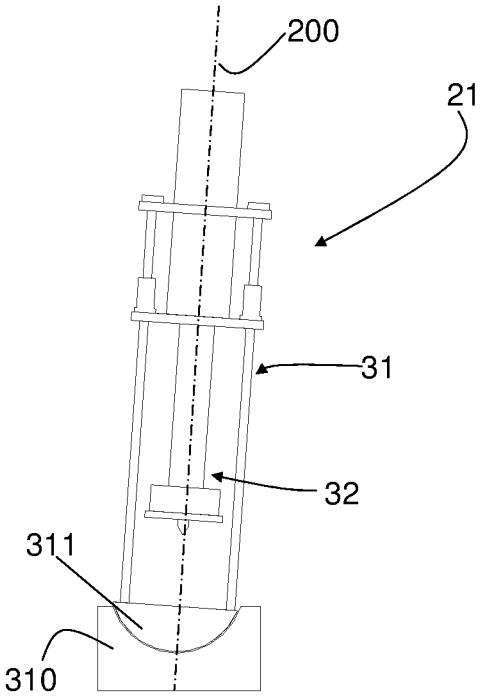
Figure 10:
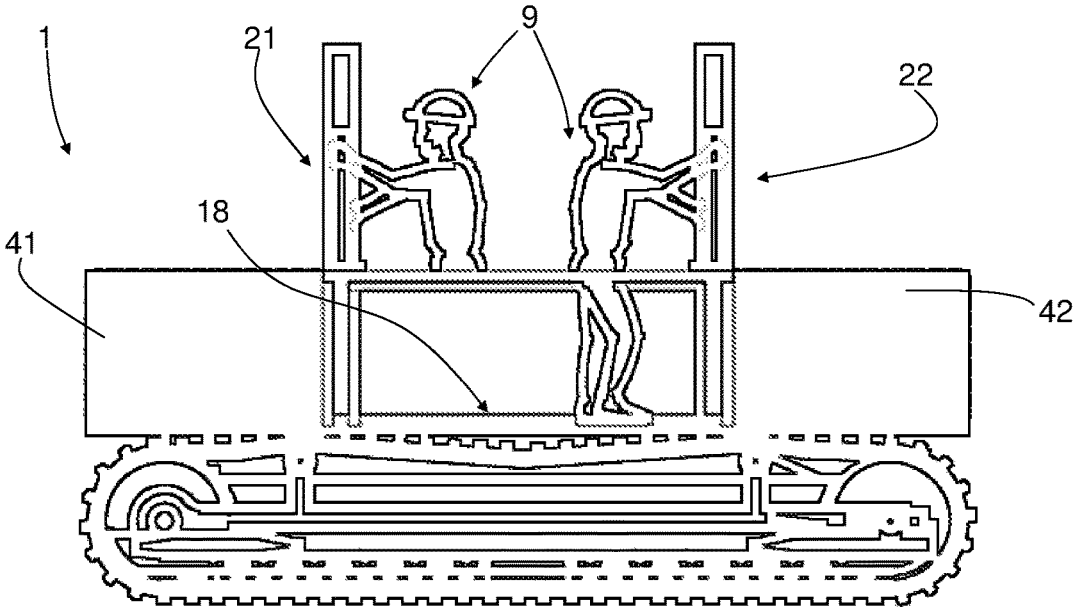
FIG. 10 is a side view of a pile-driving vehicle according to this invention, during use.

As shown in the figures, the first driving apparatus 21 and the second driving apparatus 22 are positioned in a central region of the chassis 11. In particular, the driving apparatuses 21, 22 are in a region extending in the form of a bridge between the crawler tracks 15, as shown in FIG. 2. During the driving procedure, the piles pass in the empty space between the two crawler tracks 15. That is useful for providing a high level of vehicle 1 stability during the driving procedure. In fact, the positioning in the central region allows balanced distribution of the moments of force in action.

Specifically, said central region is interposed between the first ballast 41 and the second ballast 42. In other words, the driving apparatuses 21, 22 act in a region that is surrounded by the ballasts 41, 42 and by the crawler tracks 15, which is advantageous for stability and balanced distribution of forces and moments of the forces.

In particular, the central region comprises a platform or flatbed 18 adapted to receive the at least one operator 9 who manoeuvres the driving apparatuses 21, 22, in particular for positioning in them the piles (or their pieces 93) to be driven in.

In the embodiment illustrated, one driving apparatus (for example, the first apparatus 21) is closer to a front region of the chassis 11 and the other driving apparatus (for example, the second apparatus 22) is closer to a region of the chassis 11. In other words, the driving apparatuses 21, 22 are at a distance from each other along a line that corresponds to a line of movement of the vehicle 1. For example, that is useful for driving in a plurality of piles in a row: the vehicle 1 can be gradually moved along the row and for each position of the vehicle 1 allows two piles to be driven in, substantially simultaneously, as described above.

Even more particularly, the first driving apparatus 21 and the second driving apparatus 22 are positioned at a longitudinal middle axis 100 of the chassis 11.

In the embodiment illustrated, the distance between the first driving apparatus 21 and the second driving apparatus 22 is adjustable. For example, the chassis 11 comprises a lane 28 in which the first member 31 of a driving apparatus 21, 22 is slidable towards or away from the other driving apparatus 22, 21. The first member 31 is fixable in different positions in the lane 28, thereby allow adjustment of the distance between the first member 31 of the apparatus 21, 22 and the first member 31 of the other apparatus 22, 21. That is useful for varying and adjusting the distance between the first pile and the second pile to be driven in, allowing the two piles to be simultaneously driven in at a desired distance without the need to move the vehicle 1.

In particular, both apparatuses 21, 22 have a respective first member 31 that is slidable in a respective lane 28.

As shown in FIGS. 7A to 9B, for each driving apparatus 21, 22 the tilt angle of the driving line 200 relative to the chassis 11 is variable. That is useful for allowing pile driving along a desired line (for example, vertical) even when the soil is sloping or in any case not perfectly horizontal and therefore the vehicle 11 itself is not horizontal.

Whilst in many situations the piles 91, 92 must be driven in substantially parallel to each other, in other cases the piles 91, 92 must be driven in tilted relative to one another, forming a kind of "stand" for supporting a foundation 95 (see FIG. 13). The possibility of varying the tilt angle of the driving line 200 (in particular differently for the two apparatuses 21, 22) is also useful for this purpose.

For example, the base plate 310 of the first member comprises a cradle seat (or a concave seat with spherical surface) in which a cap element 311 shaped to match the seat is positioned. The guiding rods 315 are fixed to the cap element 311.

The cap element 311 is movable in the cradle seat. A fixing system (not shown) allows fixing of the position of the cap element 311 relative to the base plate 310.

Thanks to the cradle seat and the cap element 311 working in conjunction with each other, the first member 31 is constrained to the chassis 11 in such a way that it can be tilted. Specifically, the driving line 200 may be varied through 360° in the azimuthal plane (that is to say, in the plane corresponding to the plan view projection on the vehicle 1) and also has a range of variation relative to the direction perpendicular to the azimuthal plane 20 (that is to say, relative to the vertical when the vehicle 1 is precisely flat).

In the embodiment illustrated in the figures, each driving apparatus 21, 22 comprises a rotation device 25 that is adapted to make the second member 32 rotate about the driving line 200, so as to make the respective pile rotate about its longitudinal axis.

In particular, that rotation device 25 comprises a motor 251 that, by means of a suitable motion transmission (for example chain or belt 252), is adapted to make the thrust element 321 of the second member 32 rotate, the thrust element 321 (or even the entire second member 32) being mounted in such a way that it can rotate about the driving line 200. Thanks to the friction between the thrust element 321 and the end of the pile in contact with it, the thrust element 321 makes the pile rotate about the longitudinal axis of the latter, which coincides with the driving line 200.

That is useful for helping to feed the pile into the soil during driving, for example in cases in which the pile is provided with outer spiral grooves. If necessary, in an alternative embodiment in which the rotation device 25 is not present or is not active, the thrust element 321 may rotate idly to allow the pile to rotate passively about its longitudinal axis under the action of the soil. The vehicle 1 may have compact dimensions. For example, it has a length of 4.8 metres, and a width of 2.2 metres and a maximum height of 3 metres when the driving apparatuses are at their maximum extension upwards. The flatbed 18 for the operators 9 has, for example, a length of 2.2 metres.

The vehicle 1 may also comprise suitable control and manoeuvring systems, position sensors, tilt sensors and any other device that is usable for facilitating pile driving operations and for performing these in the most precise and effective way possible.

An example of a method of use of the vehicle 1 for driving in a plurality of piles in a soil or the like is described below. The vehicle 1 is positioned at a region of soil into which the piles must be driven, at two first positions for piles. If necessary, the distance between the driving apparatuses 21, 22 is suitably adjusted based on the desired distance between two piles, one after another. An operator 9 prepares one driving apparatus 21, in particular bringing it into the open condition (with the second member 32 in the first, raised position) and placing in it a first piece 93 of the first pile 91 to be driven in. The driving apparatus 21 is operated and, by means of the actuating device 33, the second member 32 is pushed downwards towards the second position and, applying a driving force on the first piece 93, in turn pushes the first piece 93 into the soil. Simultaneously, the second member 32 of the other driving apparatus 22 is brought into the first position by the respective actuating device 33.

The operator 9 (or a second operator 9) places a first piece 93 of second pile 92 in the second driving apparatus 22, which is operated in order to drive in the piece 93. Simultaneously, the second member of the first driving apparatus 21 is brought into the first position. The operator 9 places a second piece 93 of first pile 91 in the first apparatus 21 (joining the second piece 93 to the piece already driven in) and operates the first apparatus 21. These alternating steps are continued until the first pile 91 and the second pile 92 have been completely driven in.

The vehicle 1 is then moved to a different position, so that it is at the next position for a third pile and a fourth pile to be driven in. Therefore, the above steps are repeated until all of the piles have been driven in.

In an alternative embodiment, which may be useful for example for driving in parallel rows of piles, the vehicle 1 comprises a plurality of pairs of driving apparatuses. Each pair is formed by a first driving apparatus 21 and a second driving apparatus 22, as described above. The first driving apparatuses 21 can be operated simultaneously with one another, but alternately to the second driving apparatuses 22, which in turn can operate simultaneously with one another. Therefore, the outward stroke of the second members 32 of the first driving apparatuses 21 corresponds to the return stroke of the second members 32 of the second driving apparatuses 22, and vice versa. The vehicle 1 basically comprises 2N driving apparatuses, of which only N can be operated simultaneously.

For example, in each pair the driving apparatuses 21, 22 are spaced along a respective line that is parallel to a line of movement of the vehicle 1, so that the vehicle 1 is usable for simultaneously driving in N parallel rows of piles. Alternatively, multiple pairs may be aligned with each other along a respective line, so that the vehicle 1 allows the driving in of multiple pairs of piles one after another, keeping the vehicle in the same position.

In particular, for the reasons already indicated above, the overall weight of the vehicle 10 is greater than the force that can be applied as a whole (simultaneously) by the actuating devices 33 of the first driving apparatuses 21 and is greater than the force that can be applied as a whole (simultaneously) by the actuating devices 33 of the second driving apparatuses 22. However, in order to limit the overall weight, this is less than the sum of the overall force that can be applied by the actuating devices 33 of the first driving apparatuses 21 and the overall force that can be applied by the actuating devices 33 of the second driving apparatuses 22.

In other words, the overall weight of the vehicle 1 is selected in such a way that it is sufficient to counterbalance the overall reaction force that is produced by the maximum number of driving apparatuses operated simultaneously, but the overall weight is less than the reaction force that would be produced if all of the driving apparatuses of the vehicle were operated simultaneously. The invention described above may be modified and adapted in several ways without thereby departing from the scope of the inventive concept.

All details may be substituted with other technically equivalent elements and the materials used, as well as the shapes and dimensions of the various components, may vary according to requirements.

The invention claimed is:

1. A pile-driving vehicle (1), comprising:

a chassis (11);

a movement system (15) for moving the vehicle (1) on a soil;

a first driving apparatus (21) for driving a first pile into the soil;

a second driving apparatus (22) for driving a second pile into the soil;

wherein each driving apparatus (21, 22) comprises a first member (31) that is constrained to the chassis (11), a second member (32) that is movable relative to the first member (31) between a first position and a second position along a driving line (200) and an actuating device (33) for moving the second member (32) relative to the first member (31), wherein each driving apparatus (21, 22) is adapted to push a respective pile, which respectively is the first pile or the second pile, into the soil by applying a pressing force on the respective pile along the driving line (200), the actuating device (33) being a hydraulic piston or a jack, wherein the pressing force has a reaction force which acts on the first member (31) and is transmitted to the chassis (11), wherein the pile-driving vehicle (1) has a weight and wherein the reaction force is balanced by the weight of the pile-driving vehicle (1), the movement of the second member (32) comprising an outward stroke towards the second position, during which the actuating device (33) pushes the second member (32) towards the soil, applying a force on the second member (32) along the driving line (200), the second member (32) being designed to transmit, to the pile to be driven in, the force along the driving line (200) which is applied by the actuating device (33), said force being the pressing force, the movement of the second member (32) comprising a return stroke towards the first position, during which the second member (32) is moved away from the soil, wherein the first driving apparatus (21) and the second driving apparatus (22) are intended to be operated alternately, in such a way that the outward stroke of the second member (32) of the first driving apparatus (21) corresponds to the return stroke of the second member (32) of the second driving apparatus (22), and vice versa, the actuating device (33) of the first driving apparatus (21) being operated in opposite way to the actuating device (33) of the second driving apparatus (22), so that, while one actuating device (33) pushes the respective second member (32) towards the second position, the other actuating device (33) returns the respective second member (32) towards the first position.

2. The pile-driving vehicle (1) according to claim 1, wherein the first driving apparatus (21) and the second driving apparatus (22) are positioned in a central region of the chassis (11).

3. The pile-driving vehicle (1) according to claim 2, wherein the central region comprises a platform or flatbed (18) adapted to receive at least one operator (9) who, during use, manoeuvres the driving apparatuses (21, 22).

4. The pile-driving vehicle (1) according to claim 1, comprising a first ballast (41) mounted in a front region of the chassis (11) and a second ballast (42) mounted in a rear region of the chassis (11), the first driving apparatus (21) and the second driving apparatus (22) being positioned in a central region of the chassis (11), the central region being interposed between the first ballast (41) and the second ballast (42).

5. The pile-driving vehicle (1) according to claim 4, wherein the central region comprises a platform or flatbed (18) adapted to receive at least one operator (9) who, during use, manoeuvres the driving apparatuses (21, 22).

6. The pile-driving vehicle (1) according to claim 1, wherein for each driving apparatus (21, 22) the tilt angle of the driving line (200) relative to the chassis (11) is variable, the first member (31) being constrained to the chassis (11) in such a way that it can be tilted.

7. The pile-driving vehicle (1) according to claim 1, wherein the distance between the first driving apparatus (21) and the second driving apparatus (22) is adjustable.

8. The pile-driving vehicle (1) according to claim 1, wherein each driving apparatus (21, 22) comprises a rotation device (25) that is adapted to make the second member (32) rotate about the driving line (200), so as to make the respective pile rotate about its longitudinal axis.

9. The pile-driving vehicle (1) according to claim 1, wherein the first driving apparatus (21) is closer to a front region of the chassis (11) and the second driving apparatus (22) is closer to a rear region of the chassis (11).

10. The pile-driving vehicle (1) according to claim 9, wherein the first driving apparatus (21) and the second driving apparatus (22) are positioned at a longitudinal middle axis (100) of the chassis (1).

11. The pile-driving vehicle (1) according to claim 1, such that, during use, the overall weight of the vehicle (1) is greater than the force that can be applied by the actuating device (33) of the first driving apparatus (21), the overall weight of the vehicle (1) is greater than the force that can be applied by the actuating device (33) of the second driving apparatus (22), the overall weight of the vehicle (1) is less than the sum of the force that can be applied by the actuating device (33) of the first driving apparatus (21) and the force that can be applied by the actuating device (33) of the second driving apparatus (22).

12. The pile-driving vehicle (1) according to claim 1, comprising a plurality of pairs each formed by a first driving apparatus (21) for driving in a respective first pile and a second driving apparatus (22) for driving in a second pile, wherein the first driving apparatuses (21) can be operated alternately to the second driving apparatuses (22), in such a way that the outward stroke of the second members (32) of the first driving apparatuses (21) corresponds to the return stroke of the second members (32) of the second driving apparatuses (22), and vice versa.

13. The pile-driving vehicle (1) according to claim 12, such that, during use, the overall weight of the vehicle (1) is greater than the overall force that can be applied by the actuating devices (33) of the first driving apparatuses (21), the overall weight of the vehicle (1) is greater than the overall force that can be applied by the actuating devices (33) of the second driving apparatuses (22), the overall weight of the vehicle (1) is less than the sum of the overall force that can be applied by the actuating devices (33) of the first driving apparatuses (21) and the overall force that can be applied by the actuating devices (33) of the second driving apparatuses (22).

14. The pile-driving vehicle (1) according to claim 1, wherein the movement system comprises crawler tracks (15), the vehicle being a tracked vehicle.

15. The pile-driving vehicle (1) according to claim 1, wherein the pile-driving vehicle comprises an electronic control system which is configured to manage the first driving apparatus (21) and the second driving apparatus (22) in order to operate them alternately, so that, under control of the electronic control system, the outward stroke of the second member (32) of the first driving apparatus (21) corresponds to the return stroke of the second member (32) of the second driving apparatus (22), and vice versa.

16. The pile-driving vehicle (1) according to claim 1, wherein the chassis (11) has a front region, a rear region, a central region and a longitudinal middle axis (100), and wherein the first driving apparatus (21) and the second driving apparatus (22) are positioned in the central region of the chassis (11) and at the longitudinal middle axis (100) of the chassis (11), the first driving apparatus (21) being closer to the front region of the chassis (11) and the second driving apparatus (22) being closer to the rear region of the chassis (11).

17. The pile-driving vehicle (1) according to claim 16, wherein the central region of the chassis (11) comprises a platform or flatbed (18) adapted to receive at least one operator (9) who, during use, manoeuvres the driving apparatuses (21, 22).

18. A method for driving a plurality of piles into a soil using a vehicle (1) comprising a first driving apparatus (21) and a second driving apparatus (22), wherein each driving apparatus (21, 22) comprises a first member (31) that is constrained to a chassis (11) of the vehicle (1), a second member (32) that is movable relative to the first member (31) along a driving line (200) between a first position at a distance from the soil and a second position near to the soil, and an actuating device (33) for moving the second member (32) relative to the first member (31), the actuating device (33) being a hydraulic piston or a jack, wherein each pile is composed of a plurality of pieces that are driven in one after another until the desired overall length and depth are reached, the method comprising the steps of:

a) positioning the vehicle (1) at a region of soil into which a first pile (91) and a second pile (92) must be driven;

b) bringing the second member (32) of the first driving apparatus (21) into the first position;

c) placing a piece (93) of the first pile (91) in the first driving apparatus (21) and driving in the piece (93) of the first pile (91) by the first driving apparatus (21), the actuating device (33) pushing the second member (32) towards the second position and the second member (32) applying a pressing force on the piece (93) of the first pile (91), whilst the second member (32) of the second driving apparatus (22) is brought into the first position;

d) placing a piece (93) of the second pile (92) in the second driving apparatus (22) and driving in the piece (93) of the second pile (92) by the second driving apparatus (22), the actuating device (33) pushing the second member (32) towards the second position and the second member (32) applying a pressing force on the piece (93) of the second pile (92), whilst the second member (32) of the first driving apparatus (21) is returned to the first position;

e) repeating steps c) and d) with subsequent pieces (93) of the first pile (91) and of the second pile (92), whereby the first pile (91) and the second pile (92) are driven in a substantially simultaneous way by alternating driving of the pieces (93) of the first pile (91) with driving of the pieces (93) of the second pile (92), until driving in of the first pile (91) and of the second pile (92) is complete;

f) moving the vehicle (1) to a different position and repeating said steps to drive in a third pile and a fourth pile.

19. A pile-driving vehicle (1), comprising:

a chassis (11);

a movement system (15) for moving the vehicle (1) on a soil;

a first driving apparatus (21) for driving a first pile into the soil;

a second driving apparatus (22) for driving a second pile into the soil;

wherein each driving apparatus (21, 22) comprises a first member (31) that is constrained to the chassis (11), a second member (32) that is movable relative to the first member (31) between a first position and a second position along a driving line (200) and an actuating device (33) for moving the second member (32) relative to the first member (31), wherein each driving apparatus (21, 22) is adapted to push a respective pile, which respectively is the first pile or the second pile, into the soil by applying a pressing force on the respective pile along the driving line (200), the actuating device (33) being a hydraulic piston or a jack, wherein the pressing force has a reaction force which acts on the first member (31) and is transmitted to the chassis (11), wherein the pile-driving vehicle (1) has an overall weight and wherein, during use, the reaction force is balanced by the overall weight of the pile-driving vehicle (1), the movement of the second member (32) comprising an outward stroke towards the second position, during which the actuating device (33) pushes the second member (32) towards the soil, applying a force on the second member (32) along the driving line (200), the second member (32) being designed to transmit, to the pile to be driven in, the force along the driving line (200) which is applied by the actuating device (33), said force being the pressing force, the movement of the second member (32) comprising a return stroke towards the first position, during which the second member (32) is moved away from the soil, wherein the first driving apparatus (21) and the second driving apparatus (22) are intended to be operated alternately, in such a way that the outward stroke of the second member (32) of the first driving apparatus (21) corresponds to the return stroke of the second member (32) of the second driving apparatus (22), and vice versa, wherein the first driving apparatus (21) has a maximum pressing force that can be applied by the actuating device (33) of the first driving apparatus (21) and the second driving apparatus (22) has a maximum pressing force that can be applied by the actuating device (33) of the second driving apparatus (22), wherein:

the overall weight of the vehicle (1) is greater than the maximum pressing force of the first driving apparatus (21);

the overall weight of the vehicle (1) is greater than the maximum pressing force of the second driving apparatus (22);

the overall weight of the vehicle (1) is less than the sum of the maximum pressing force of the first driving apparatus (21) and the maximum pressing force of the second driving apparatus (22).

* * * * *